United States Patent [19]

Lear

[11] 4,038,852

[45] Aug. 2, 1977

[54] SCROLL-FORMING DEVICE

[76] Inventor: Ronald Lear, 4 Bellgrave Road, Eastwood, Leigh-on-Sea, Essex, England

[21] Appl. No.: 682,678

[22] Filed: May 3, 1976

[30] Foreign Application Priority Data

May 6, 1975 United Kingdom ..... 18893/75

[51] Int. Cl.[2] ..... B21C 47/00

[52] U.S. Cl. ..... 72/147; 72/148

[58] Field of Search ..... 29/173; 72/146, 147, 72/148; 267/156, 167

[56] References Cited

U.S. PATENT DOCUMENTS

| | | | |
|---|---|---|---|
| 664,771 | 12/1900 | McCallum | 72/147 |
| 896,116 | 8/1908 | Jewett | 72/147 |
| 3,750,719 | 8/1973 | Goldman et al. | 72/148 |

FOREIGN PATENT DOCUMENTS

| | | | |
|---|---|---|---|
| 835,913 | 1/1939 | France | 72/148 |
| 590,410 | 1/1934 | Germany | 72/148 |

*Primary Examiner*—E. M. Combs
*Attorney, Agent, or Firm*—Emory L. Groff, Jr.

[57] ABSTRACT

A device for forming a scroll from a strip of metal, such as is used in the manufacture of wrought ironwork. An outer former with a generally cylindrical surface and a slot is rotatably mounted on a base plate and an inner former also with a substantially cylindrical surface is rotatably mounted eccentrically on the outer former. A clamping member is eccentrically arranged on the inner forming surface, so that a strip extending through the slot to lie adjacent the inner forming surface may be clamped thereto by the clamping member during relative rotation between the clamping member and the inner forming surface. Thereafter, continued rotation of the inner forming surface wraps the strip therearound while stop means prevent rotation of the outer former. The stop means is then released to allow the outer former to rotate with the inner former thereby completing the scroll by wrapping the strip around the outer forming surface.

10 Claims, 8 Drawing Figures

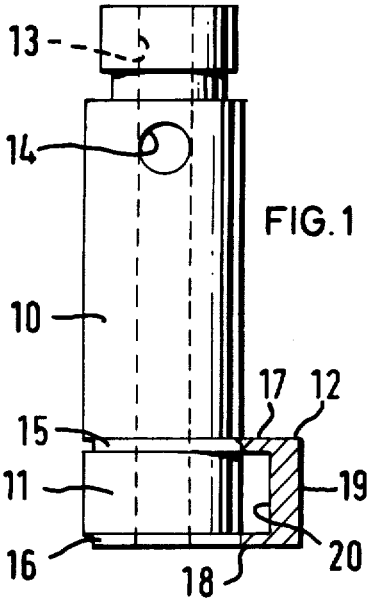
FIG. 1
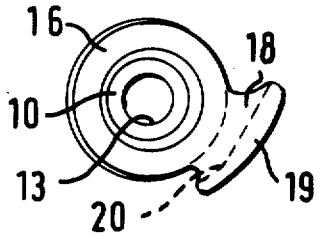
FIG. 2
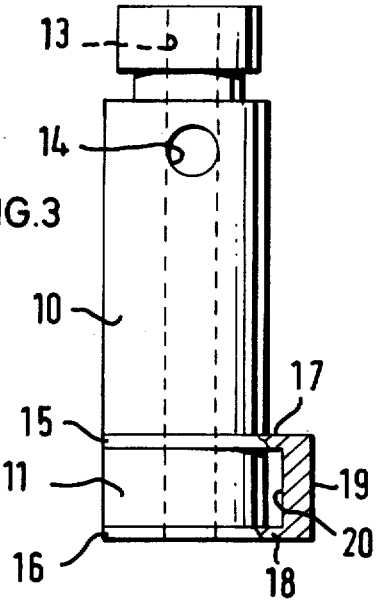
FIG. 3
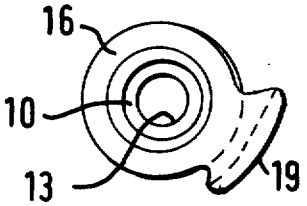
FIG. 4
FIG. 5
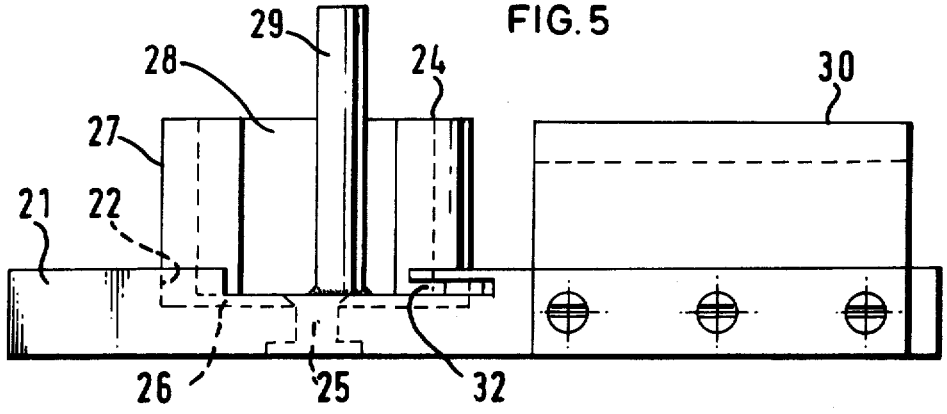

SCROLL-FORMING DEVICE

BACKGROUND OF THE INVENTION a. Field of the Invention

The invention relates to a device for forming a scoll from a strip of material and especially from a strip of mild steel or wrought iron. Such scrolls are used in artistic metalwork, such as wrought iron gates, pillars and supports for various articles such as lamps, shelving and so on.

b. Description of the Prior Art

When producing artistic metalwork such as is commonly referred to as wrought iron, it is usual to fabricate the work from pre-formed strips of material welded or brazed together, the end portion of each strip of material being wrapped round into a scroll so as neatly to terminate it. The usual way to make the scrolls is to insert into a suitable jig a series of pins upstanding from the plane of the support and around which a strip of metal — such as mild steel — can be bent directly by hand. Though this method works quite satisfactorily, it takes a fair measure of skill to produce uniform scrolls and not to distort the strip so that the two edges thereof do not lie in two parallel planes.

OBJECTS OF THE INVENTION

It is a primary object of this invention to provide a device for forming scrolls which is capable of producing quickly and easily uniform scrolls on the end portions of strips of metal — and especially strips of mild steel. It is another object of this invention to provide a device for forming a scroll which does not damage the end portion of the strip being so-formed. It is a further object of this invention to provide a device for forming a scroll from a strip of material which scroll, when formed thereby, has its two side edges lying respectively in two parallel planes.

In accordance with these and othe objects of the invention, there is provided a device for forming a scroll from a strip of material, which device comprises:

a base plate;

a hollow outer former having a substantially cylindrical forming surface with an axial slot therein, the outer former being rotatably mounted about its cylindrical axis to said base plate;

an inner former also having a substantially cylindrical forming surface and rotatably mounted on and within said outer former, the axes of said two formers being parallel;

a clamping member rotatably mounted eccentrically on said inner former, the clamping member having a clamping surface facing said forming surface of the inner former, which clamping surface is movable nearer to and further from said forming surface of the inner former as the inner former and the clamping member are relatively rotated; and releasable stop means provided on said base plate to prevent rotation of said outer former relative to the base plate during an initial rotation of said inner former in which a strip to be formed into a scroll and extending through said slot is first clamped by said clamping member to the forming surface of said inner former and then wrapped partially around the forming surface of said inner former, said stop means then being releasable to allow said outer former to be rotated with said inner former so as to wrap the strip around said outer forming surface, thereby completing the scroll.

It will be appreciated that a scroll formed from a strip of metal by the above device will have two essentially part-cylindrical portions of different radii of curvature. However, by adjusting the relative radii of curvature, the scroll formed by the device of this invention can give a very close approximation to the ideal, aesthetically correct form of scroll for wrought ironwork. To give the best possible form of scroll, the inner former should be rotatably mounted on and within the outer former with its axis parallel to but not co-incident with that of the outer former; the preferred arrangement is for the axis of the inner former to lie part-way between that of the outer former and said slot in the outer forming surface. It is further preferred for the forming surface of said inner former to extend partially into the slot in the forming surface of the outer former.

It is a further object of this invention to provide a device which relatively easily forms a metal strip into the desired scroll shape. To this end, the inner former should comprise a core member and a forming roller, the forming roller being concentrically and rotatably mounted on the core member with the outer surface of the forming roller comprising said forming surface of the inner former, and the core member being rotatably mounted on the outer former. For this arrangement, the clamping member should be rotatably mounted eccentrically on the core member, so that relative rotation of the core member will move the clamping surface relative to the forming roller so as to allow clamping of a strip therebetween.

A further object of this invention is to provide a device for forming a scroll as described above, in which said releasable stop means is releasable automatically at the end of said initial rotation of the inner former so that the scroll may be formed in one simple operation without separately and manually having to release said stop means. To this end, it is preferred for the stop means to comprise a peg which extends through an aperture provided in said outer former, said peg being moved out of interlocking engagement with said outer former by the clamping member at the end of said initial rotation.

These and other objects of this invention will become apparent from the following description of a preferred embodiment of this invention.

BRIEF DESCRIPTION OF THE DRAWINGS

By way of illustration of this invention, one embodiment of a scroll-forming device will now be described with reference to the accompanying drawings. In the drawings:

FIG. 1 is a part-sectional view of an assembly of a core member, forming roller and clamping member of the preferred embodiment of scroll-forming device constructed in accordance with this invention;

FIG. 2 is an end view of said assembly of FIG. 1;

FIG. 3 is a view of the same assembly of FIG. 1, but with the clamping member and core member in another relative disposition;

FIG. 4 is an end view on the assembly in the disposition of FIG. 3;

FIG. 5 is a side view of the base plate of the scroll-forming device, with the outer former and a guide plate for a strip in position;

DESCRIPTION OF THE PREFERRED EMBODIMENT

Figure 6:
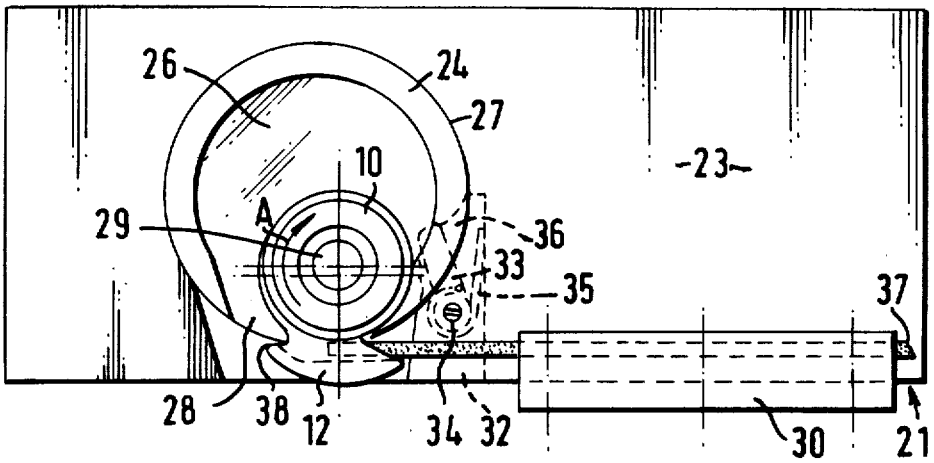
FIG. 6 is a plan view of the complete scroll-forming device, shown in an initial position with a strip engaged therewith.

Referring initially to FIGS. 1 to 4, there is there shown an assembly consisting of a core member 10 and a forming roller 11, together comprising the inner former of this invention, and a clamping member 12. The core member 10 is generally cylindrical, and is provided with an axial bore 13 by means of which the core member may be rotatably mounted as described below. Extending transversely through the upper part of the core member 10 is a tommy-bar hole 14. The lower end of the core member 10 is provided with a succession of three cylindrical surfaces (not shown) on the middle one of which the forming roller 11 is rotatably mounted. On the other two, comprising respectively that nearest to and that furthest from the lower end of the core member 10, is rotatably mounted the clamping member 12. Said other two surfaces are eccentric with respect to the remainder of the core member 10 such that relative rotation between the clamping member 12 and the core member 10 will cause the clamping member 12 to move transversely with respect to the axis of the core member 10. The clamping member itself, considered in side view, is generally U-shaped, and as can be seen from FIGS. 2 and 4 has two generally annular plates 15 and 16 each provided with a lug 17 and 18, the lugs 17 and 18 being interconnected by a portion 19, which portion provides a clamping surface 20 facing the inner scroll forming surface of the forming roller 11.

FIGS. 1 - 2, and FIGS. 3 - 4 respectively show the core member 10 and clamping member 12 at the extremes of possible eccentric movement therebetween; the dispositions of the core member 10 and clamping member 12 are 180° different respectively in the arrangements of FIGS. 1 and 2, and FIGS. 3 and 4. Thus, as will be appreciated from the drawings, the spacing between the clamping surface 20 and surface of the forming roller 11 varies dependent upon the relative dispositions of the core member 10 and clamping member 12.

Referring now to FIG. 5, there is shown the base plate and outer former for use in conjunction with the assembly of FIGS. 1 to 4. The base plate 21 comprises a generally flat plate having a circular recess 22 in its upper face 23, in which circular recess the outer former 24 is rotatably mounted. The outer former 24 is held in position by a stud 25 co-axial with both the former 24 and circular recess 22 and passing through the base wall 26 of the outer former 24 as well as through the base plate 21.

The outer former itself comprises a generally cylindrical wall 27 upstanding from the base wall 26, there being an axial slot 28 in the cylindrical wall 27. Upstanding from the base wall 26 of the outer former 24 is a pin 29 upon which the assembly of FIGS. 1 to 4 may be mounted by the bore 13 in the core member 10, the pin 29 being disposed part-way between the stud 25 of the outer former 24 and the slot 28 in the cylindrical wall 27.

Screwed firmly to a side face of the base plate 21 is a guide plate 30 for strip to be formed into a scroll, the precise function of which will be described in detail below.

A channel 32 is provided in the base plate extending parallel to the upper face 23 but spaced slightly therebelow. In this channel there is pivotally mounted a stop-peg 33 (see FIGS. 6–8) on grub-screw 34, which peg is biased by a spring 35 generally towards the stud 25. An aperture 36 is provided through the cylindrical wall 27 of the outer former 24, the wall 27 of the aperture being generally rounded as shown in FIG. 6.

Figure 7:
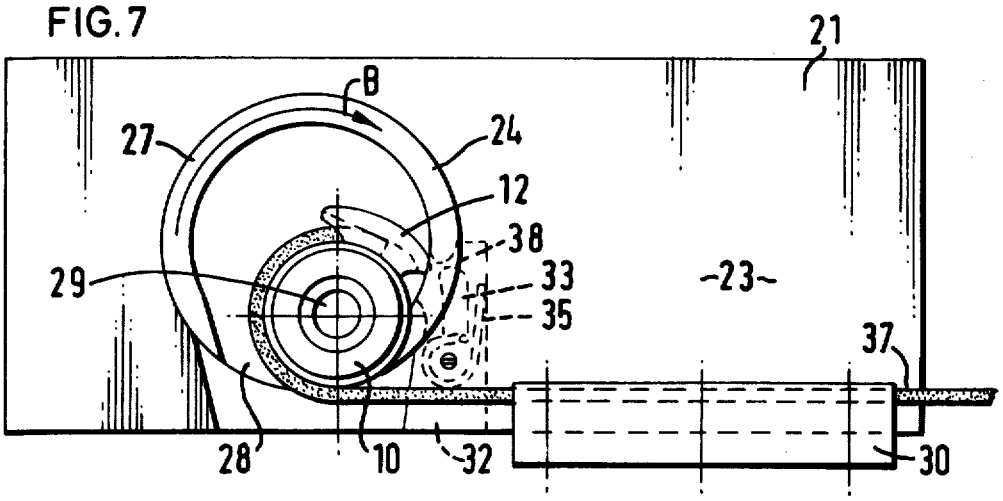
FIG. 7 is a view similar to that of FIG. 6, but with a scroll part-formed.

The assembly of FIGS. 1 to 4 and the base plate and outer former 24 of FIG. 5 are assembled together by sliding the core member 10 over the in 29, so that the parts have the relative disposition shown in FIG. 6, with the forming roller 11 lying partially within the slot 28 of the outer former 24. The core member is turned relative to the clamping member 12 so that the gap between the clamping surface 20 and the outer surface of the forming roller 11 is at a maximum and so that portion 19 of the clamping member 12 extends through the slot 28. The outer former 24 itself is turned so that the peg 33 projects through the aperture 36 therein, and thereby prevents rotation clockwise of the outer former 24 with respect to the base plate 21. A tommy-bar (not shown) is passed through hole 14 in the core member, and when thus assembled the apparatus is ready for use to form a scroll from a strip of ductile metal such as mild steel.

Initially, the strip 37 to be formed is placed against the guide plate, on the same side thereof as the major portion of the base plate 21, and the free end of the strip is fed into the gap between the clamping surface 20 of the clamping member 12 and the forming roller 11, as shown in FIG. 6. Then, the core member 10 is rotated clockwise as shown by arrow A. Initially, only the core member 10 rotates, the roller 11 and the clamping member 12 remaining stationary. Because of the eccentricity of the mounting of the clamping member 12, this rotation diminishes the gap between the clamping surface 20 and the forming roller 11 until the strip is firmly clamped therebetween. Eventually, when the strip is tightly clamped, no more relative movement can take place and the clamping member 12 and forming roller 11 start to rotate with the core member 10, thus wrapping the end portion of the strip around the forming surface, the strip of course sliding past the guide plate 30 in this process. The outer former 24 is, during this initial rotation, held stationary by the stop-peg 33.

Figure 8:
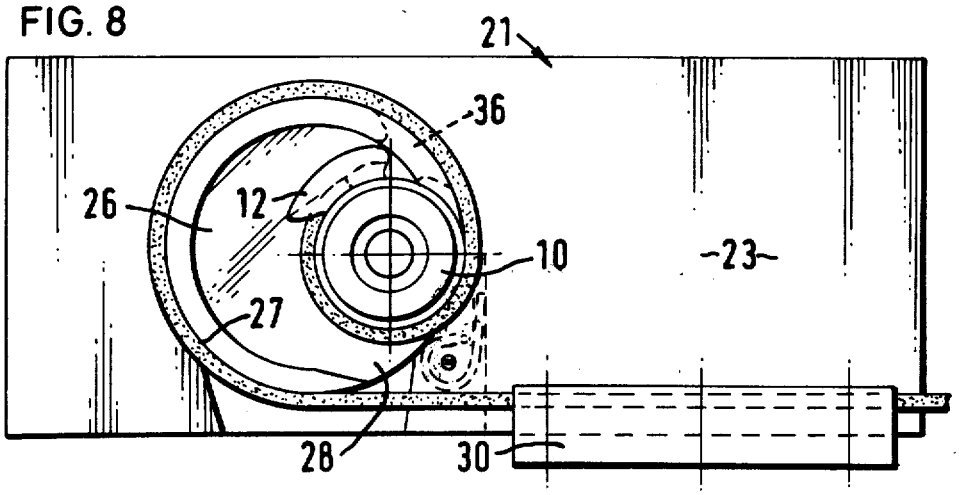
FIG. 8 is a view similar to that of FIG. 6 but with a scroll shown completely formed.

After approximately 210° of rotation of the forming roller 11 and clamping member 12, the leading edge 38 of the clamping member 12 engages the stop-peg and commences to move the peg 33 against its spring bias out of the aperture 36 in the outer former 24. By this action, the outer former 24 is released enabling it to move clockwise relative to the base plate 21; continued rotation of the core member 10 moves the outer surface of portion 19 of the clamping member 12 into positive engagement with the outer former 24, so as to impart a drive thereto. From this point, the core member 10, forming roller 11, clamping member 12 and the outer former 24 are all rotated relative to the base plate in unison and the strip is thereafter wrapped around the cylindrical wall 27 of the outer former 24, as shown in FIG. 8. The scroll is completed when the outer former 24 has turned through approximately 270°.

Once formed, the scroll is removed from the device by rotating the core member anti-clockwise so as to widen the gap between the clamping surface 20 of the clamping member 12 and the forming roller 11. Once released, the scroll complete with the assembly of FIGS. 1 to 4 can be lifted off the pin 29, and then the assembly of FIGS. 1 to 4 can be dismantled by with-drawing the core member 10 from the forming roller 11 and clamping member 12, whereafter said two latter parts may be released from the scroll itself.

The arrangement described above is suitable for forming scrolls from strips of material of essentially a single thickness only. If strips of a different thickness are to be formed, it is necessary to change the clamping member 12 for a different one, in which there is provided a gap between the clamping surface 20 and the forming roller 11 suitable for the strip to be formed into a scroll. Any width of strip may be formed into a scroll provided that it may be entered into the gap between the forming roller 11 and the clamping surface 20 — that is to say, provided that the width of the strip does not exceed the width of the forming roller 11.

Though described as "generally cylindrical" the precise shape of the forming roller 11 need not be exactly cylindrical, and the shape of the scroll produced may be modified by modifying the precise shape of the forming roller 11. For example, the forming roller 11 may have an outer surface which is itself slightly scroll-shaped; in this case, there clearly must be a discontinuity at some point in its outer surface. Another possibility is to provide a flat on the outer surface of the forming roller 11, which flat is intended to be disposed opposed to the clamping surface 20 of the clamping member 23, so as to assist the clamping action thereof. The disadvantage of this possibility, however, is that the very end portion of the scroll formed by the device also has a flat, tang-like portion, which spoils the overall scroll shape.

In a similar way, the outer wall 27 of the outer former 24 may also be modified somewhat from a true cylindrical shape. For the precise embodiment described above, the portion of the wall 27 which is received in the circular recess 22 must also be circular so as to allow the outer former 24 to rotate on stud 25, but the portion of the wall 27 above the base plate 21 may be modified — for example to have a slight scroll-shaped. Again such a modification may improve the final shape of the scroll formed in a piece of strip.

To strengthen the whole assembly, a cover plate (not shown) may be provided which fits around the core member 10 above the clamping member and also rests on the upper surface of the outer former 24, the cover plate having a downwardly depending lip which fits around the outer wall 27. This cover plate thus takes most of the bending loads off the pin 29 as the core member 10 is rotated to form a scroll.

I claim:

1. A device for forming a scroll from a strip of material, which device comprises:

a base plate;

a hollow outer former having a substantially cylindrical forming surface with an axial slot therein, the outer former being rotatably mounted about its cylindrical axis to said base plate;

an inner former also having a substantially cylindrical forming surface and rotatably mounted on and within said outer former, the axes of said two formers being parallel;

a clamping member rotatably mounted eccentrically on said inner former, the clamping member having a clamping surface facing said forming surface of the inner former, which clamping surface is movable nearer to and further from said forming surface of the inner former as the inner former and the clamping member are relatively rotated; and releasable stop means provided on said base plate to prevent rotation of said outer former relative to the base plate during an initial rotation of said inner former in which a strip to be formed into a scroll and extending through said slot is first clamped by said clamping member to the forming surface of said inner former and then wrapped partially around the forming surface of said inner former, said stop means then being releasable to allow said outer former to be rotated with said inner former so as to wrap the strip around said outer forming surface.

2. A device according to claim 1, in which the inner former comprises a core member rotatably mounted on the outer former and a forming roller rotatably mounted on the core member, the outer surface of the forming roller comprising said substantially cylindrical forming surface disposed within the outer former.

3. A device according to claim 2, wherein the clamping member has two annular plates between which the forming roller is disposed, the annular plates being rotatably mounted eccentrically on said core member and being interconnected by a portion providing said clamping surface facing said forming roller.

4. A device according to claim 3, wherein said releasable stop means comprises a stop-peg and an aperture in the outer former, the stop peg being inter-engageable with the aperture, the inter-engagement therebetween restraining relative rotation of the outer former with respect to the base plate.

5. A device according to claim 4, wherein the clamping member includes a leading edge, said leading edge engaging and automatically moving the stop peg out of engagement with the outer former at the termination of said initial rotation of the inner former.

6. A device as claimed in claim 5, wherein said stop peg is biased by spring means to said position in which it projects through said aperture in the said outer former so as to prevent rotation of the outer former.

7. A device according to claim 1, wherein said releasable means comprise a stop peg biased by spring means towards a position in which it projects through an aperture in said outer former so as to engage a wall thereof, the interengagement restraining relative rotation of said outer former with respect to the base plate.

8. A device according to claim 4, wherein the clamping member includes a leading edge, said leading edge engaging and automatically moving the stop peg out of engagement with the outer former at the termination of said initial rotation of the inner former.

9. A device according to claim 1, wherein said inner former is rotatably mounted on said outer former partway between the axis of the outer former and said slot in the forming surface thereof.

10. A device according to claim 9, wherein said forming surface of the inner former projects partially into said slot of said outer former.

* * * * *